US009425556B1

(12) United States Patent
Pickel

(10) Patent No.: US 9,425,556 B1
(45) Date of Patent: Aug. 23, 2016

(54) INTERCONNECTION SYSTEM AND AN ELECTRICAL CONNECTOR HAVING RESONANCE CONTROL

(71) Applicant: Tyco Electronics Corporation, Berwyn, PA (US)

(72) Inventor: Justin Dennis Pickel, Hummelstown, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 14/802,406

(22) Filed: Jul. 17, 2015

(51) Int. Cl.

| | |
|---|---|
| ***H01R 13/648*** | (2006.01) |
| ***H01R 13/6467*** | (2011.01) |
| ***H01R 13/6581*** | (2011.01) |
| ***H01R 13/6582*** | (2011.01) |

(52) U.S. Cl.
CPC ..... *H01R 13/6467* (2013.01); *H01R 13/6581* (2013.01); *H01R 13/6582* (2013.01)

(58) Field of Classification Search
CPC ..... H01R 13/6467; H01R 13/6581; H01R 13/6582; H01R 23/6893; H01R 23/7073
USPC ..... 439/79, 607.35–607.4, 607.55
See application file for complete search history.

(56) References Cited

U.S. PATENT DOCUMENTS

| | | | | |
|---|---|---|---|---|
| 8,398,432 | B1 | 3/2013 | McClellan et al. | |
| 8,430,691 | B2 | 4/2013 | Davis | |
| 8,444,434 | B2 | 5/2013 | Davis et al. | |
| 8,500,487 | B2 | 8/2013 | Morgan et al. | |
| 8,591,260 | B2 | 11/2013 | Davis et al. | |
| 8,777,663 | B2 | 7/2014 | Annis et al. | |
| 9,093,800 | B2 * | 7/2015 | Laub | H01R 12/727 |
| 9,136,634 | B2 * | 9/2015 | De Geest | H01R 12/724 |
| 9,281,624 | B2 * | 3/2016 | Jeon | H01R 13/6477 |

* cited by examiner

*Primary Examiner* — Khiem Nguyen

(57) ABSTRACT

Interconnection system includes a mating connector having a plurality of terminal sub-assemblies that include a signal terminal and a ground shield. The interconnection system also includes an electrical connector having a plurality of contact sub-assemblies that each include a signal contact and a resonance-control shield that. The terminal sub-assemblies of the mating connector engage corresponding contact sub-assemblies of the electrical connector when the mating and electrical connectors are mated. The signal terminals of the terminal sub-assemblies engage the signal contacts of the corresponding contact sub-assemblies. Each of the ground shields of the terminal sub-assemblies is inserted between the resonance-control shield and the signal contact of the corresponding contact sub-assembly. The ground shield and the resonance-control shield have respective broad surfaces that face each other with a capacitive gap therebetween.

20 Claims, 8 Drawing Sheets

INTERCONNECTION SYSTEM AND AN ELECTRICAL CONNECTOR HAVING RESONANCE CONTROL

BACKGROUND

The subject matter herein relates generally to electrical connectors that have signal conductors configured to convey data signals and ground conductors that control impedance and reduce crosstalk between the signal conductors.

Communication systems exist today that utilize electrical connectors to transmit data. For example, network systems, servers, data centers, and the like may use numerous electrical connectors to interconnect the various devices of the communication system. Many electrical connectors include signal conductors that convey data signals and ground conductors that provide a return path for current. The ground conductors may also be used to reduce crosstalk between the signal conductors and control impedance. In differential signaling applications, the signal conductors are arranged in signal pairs for carrying the data signals. Each signal pair may be separated from an adjacent signal pair by one or more ground conductors.

There has been a general demand to increase the density of signal conductors within the electrical connectors and/or increase the speeds at which data is transmitted through the electrical connectors. As data rates increase and/or distances between the signal conductors decrease, however, it becomes more challenging to maintain a baseline level of signal integrity. For example, in some cases, electrical energy that flows on the surface of each ground conductor of the electrical connector may be reflected and resonate within cavities formed between ground conductors. Unwanted electrical energy may be supported between one ground conductor and nearby ground conductors. Depending on the frequency of the data transmission, electrical noise may develop that increases return loss and/or crosstalk and reduces throughput of the electrical connector.

To control resonance between conductors and limit the effects of the resulting electrical noise, it has been proposed to electrically common separate ground conductors using a metal conductor or a lossy plastic material. The effectiveness and/or cost of implementing these techniques is based on a number of variables, such as the geometry of the electrical connector and geometries of the signal and ground conductors within the electrical connector. For some applications and/or electrical connector configurations, alternative methods for controlling resonance between the ground conductors may be desired.

Accordingly, there is a need for electrical connectors that reduce the electrical noise caused by resonating conditions between ground conductors.

BRIEF DESCRIPTION

In an embodiment, an interconnection system is provided that includes a mating connector having a plurality of terminal sub-assemblies. Each of the terminal sub-assemblies includes a signal terminal and a ground shield that is proximate to the signal terminal to shield the signal terminal from other terminal sub-assemblies. The interconnection system also includes an electrical connector having a plurality of contact sub-assemblies that each include a signal contact and a resonance-control shield that is proximate to the signal contact of the corresponding contact sub-assembly. The terminal sub-assemblies of the mating connector engage corresponding contact sub-assemblies of the electrical connector when the mating and electrical connectors are mated. The signal terminals of the terminal sub-assemblies engage the signal contacts of the corresponding contact sub-assemblies. Each of the ground shields of the terminal sub-assemblies is inserted between the resonance-control shield and the signal contact of the corresponding contact sub-assembly. The ground shield and the resonance-control shield have respective broad surfaces that face each other with a capacitive gap therebetween.

In some aspects, each of the resonance-control shields includes a spring member that engages the corresponding ground shield at a contact zone such that current is permitted to flow through the contact zone.

In some aspects, each of the ground shields includes a stub portion that is exposed to an exterior of the mating connector when the electrical connector and mating connector are unmated. The stub portion has the broad surface of the ground shield. Optionally, a majority of the broad surface of the ground shield overlaps with the broad surface of the corresponding resonance-control shield. Optionally, a majority of the broad surface of the resonance-control shield overlaps with the broad surface of the ground shield. Optionally, the broad surface of the ground shield and the broad surface of the resonance-control shield overlap each other by least 5 $mm^2$. Optionally, the capacitive gap is at most 0.40 mm.

In an embodiment, an electrical connector is provided that includes a connector housing having a front side configured to engage a mating connector. The connector housing includes a plurality of contact cavities having cavity openings along the front side. The electrical connector also includes a plurality of contact sub-assemblies that are positioned within corresponding contact cavities. Each of the contact sub-assemblies includes a signal contact and a resonance-control shield that is proximate to the signal contact of the corresponding contact sub-assembly. The signal contacts are configured to engage respective signal terminals of a mating connector during a mating operation between the electrical connector and the mating connector. Each of the contact cavities and the contact sub-assembly within the corresponding contact cavity are configured to permit an associated ground shield of the mating connector to be inserted between the signal contact and the resonance-control shield of the contact sub-assembly during the mating operation.

DETAILED DESCRIPTION

Figure 1:
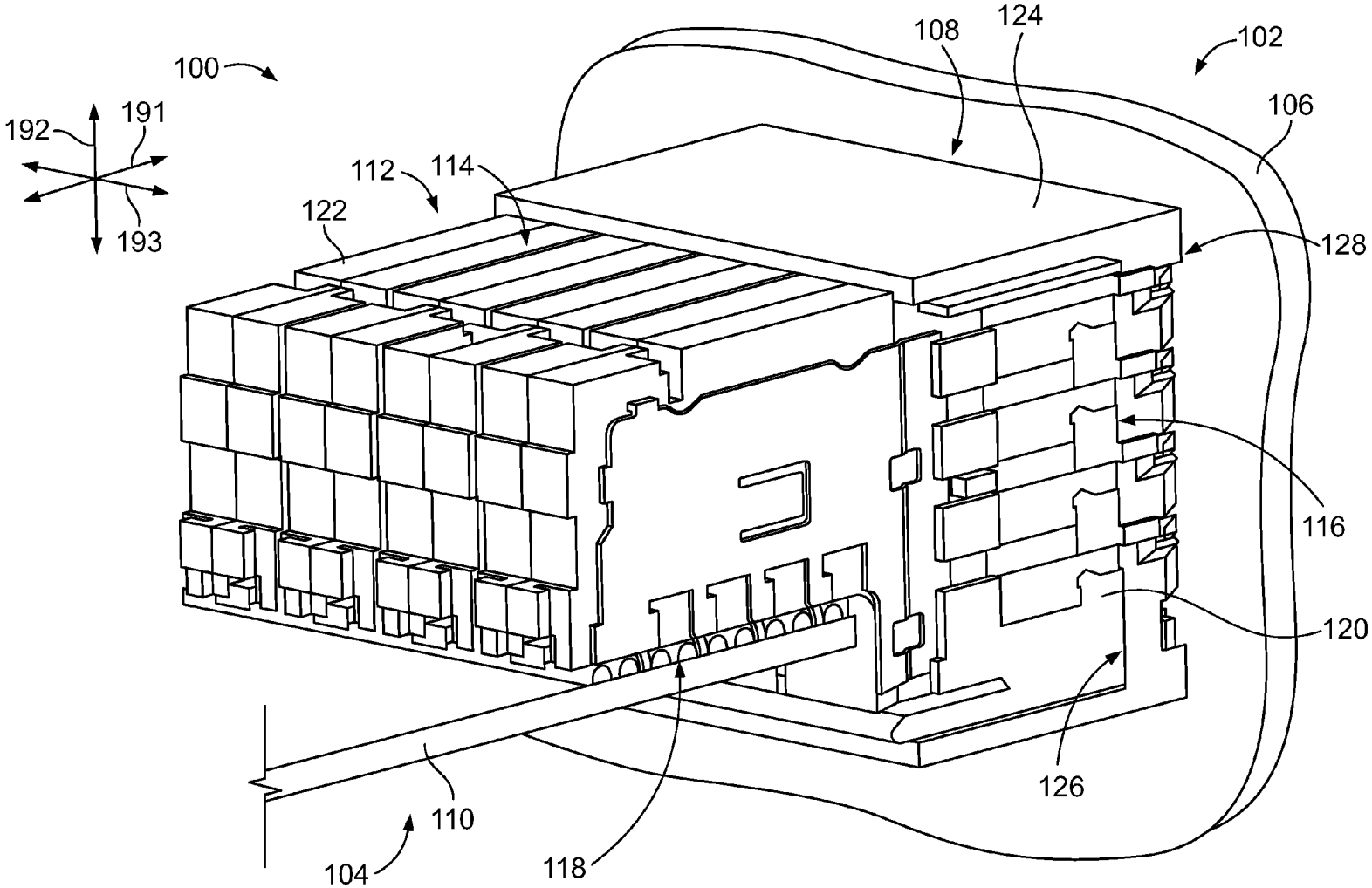
FIG. 1 is a perspective view of an interconnection system formed in accordance with an embodiment that includes a mating connector and an electrical connector that are mated with each other.

Embodiments set forth herein may include interconnection systems and electrical connectors that are configured for communicating data signals. An interconnection system may include at least two electrical connectors in which one electrical connector may mate with another electrical connector, which is hereinafter referred to as a mating connector. In some embodiments, the electrical connector is a receptacle connector of a backplane or midplane interconnection system. In other embodiments, the electrical connector may be a header connector that is configured to mate with a receptacle connector of a backplane or midplane interconnection system. However, the inventive subject matter set forth herein is not limited to backplane or midplane interconnection systems and may be applicable to other types of electrical connectors and systems.

The electrical connectors typically include a plurality of signal conductors and a plurality of ground conductors. In order to distinguish similar elements in the detailed description and claims, various labels may be used. For example, a signal conductor may be referred to as a signal contact, a signal terminal, etc. A signal conductor is configured to convey data signals. A ground conductor may be referred to as a ground shield, a resonance-control shield, etc., and may provide a ground or return path for the electrical connector. It should be understood that two similar elements having different labels do not necessarily have different structures. It should also be understood that two elements having the same label may have different structures. For example, one or more ground shields may be C-shape or L-shaped and one or more other ground shields may be blade-shaped.

Embodiments include resonance-control shields that engage and/or capacitively couple to ground shields of a mating connector. The resonance-control shields of an electrical connector are configured to directly interface with the corresponding ground shield of a mating connector. As used herein, a resonance-control shield "directly interfaces with" a corresponding ground shield if the resonance-control shield and the ground shield have respective broad surfaces that face each other with a capacitive gap therebetween. As used herein, a "broad surface" provides a non-negligible amount of surface area. For example, resonance-control shields and the ground shields may be formed (e.g., stamped-and-formed, 3D printed, and the like) to include edges and broad surfaces that extend between edges. The broad surface of the resonance-control shield and the broad surface of the ground shield may face each other with a small gap therebetween such that the broad surfaces capacitively couple to each other. In some embodiments, the capacitively coupled shields may facilitate controlling or impeding resonating conditions that may develop between ground shields. The surface areas along edges, however, may be small such that any capacitive coupling between only two edges may be insubstantial or negligible. It should be understood that the resonance-control shield and the ground shield may, optionally, engage each other through one or more contact points.

The signal conductors and ground shields are positioned relative to each other to form a predetermined array or pattern. In some embodiments, the pattern or array includes multiple rows and/or columns. The signal conductors of a single row or column may be substantially co-planar. The ground shields of a single row or column may be substantially co-planar. In an exemplary embodiment, the signal conductors form signal pairs in which each signal pair is separated from an adjacent signal pair by one or more ground shields. As used herein, the phrase "adjacent signal conductors" means first and second signal conductors that do not have any other signal conductors positioned between the first and second signal conductors. Likewise, as used herein, the phrase "adjacent signal pairs" means first and second signal pairs that do not have any other signal pairs positioned between the first and second signal pairs. It should be understood, however, that a single signal pair may be adjacent to more than one signal pair. For instance, the single signal pair may be positioned between two other signal pairs. In this example, the signal pair is adjacent to the signal pair on one side and adjacent to the signal pair on the opposite side.

The ground shields and resonance-control shields may be positioned between adjacent signal conductors (or signal pairs) to electrically separate the signal conductors (or signal pairs) and reduce electromagnetic interference or crosstalk. As used herein, a shield, such as a ground shield or a resonance-control shield, is "positioned between" adjacent signal conductors or pairs if at least a portion of the shield is positioned between the adjacent signal conductors or pairs. The shield is positioned between the adjacent signal conductors or signal pairs if a line extending between the adjacent signal conductors or pairs intersects the shield.

In some embodiments, a single ground shield (or single resonance-control shield) may be shaped to at least partially surround a corresponding signal conductor or corresponding signal pair. For example, the ground shield may include multiple shield walls that are positioned to provide the ground shield with a U-shape, C-shape, L-shape, or rectangular shape structure. The ground shield may also have a V-shape, I-shape, or X-shape. In other embodiments, multiple ground shields may be positioned to at least partially surround a corresponding signal conductor or corresponding signal pair. For example, multiple ground blades may be positioned to at least partially surround a corresponding signal conductor or corresponding signal pair. The resonance-control shields may also have shapes similar to the ground shields described herein. As described herein, the resonance-control shield may also extend along or around a corresponding ground shield. In some embodiments, a ground shield may be nested within a corresponding resonance-control shield.

As used herein, the phrases "a plurality of [elements]," "an array of [elements]," and the like, when used in the detailed description and claims, do not necessarily include each and every element that a component, such as an electrical connector or interconnection system, may have. For instance, the phrase "a plurality of ground shields having [a recited feature]" does not necessarily mean that each and every ground shield of the corresponding mating connector (or interconnection system) has the recited feature. Other ground shields of the mating connector may not include the recited feature. As another example, the claims may recite that an electrical connector includes "a plurality of resonance-control shields, each of which including a spring member." This phrase does not exclude the possibility that other resonance-control shields of the electrical connector may not have a spring member. Accordingly, unless explicitly stated otherwise (e.g., "each and every resonance-control shield of the electrical connector"), embodiments may include similar elements that do not have the recited features.

FIG. 1 is a perspective view of an interconnection system 100 formed in accordance with an embodiment. The interconnection system 100 includes a first circuit board assembly 102 and a second circuit board assembly 104 that are communicatively coupled to one another. The first circuit board assembly 102 includes a circuit board 106 and an electrical connector 108 mounted thereto. The second circuit board assembly 104 includes a circuit board 110 and an electrical connector 112 mounted thereto. In particular embodiments, the interconnection system 100 may be a backplane or midplane interconnection system such that the first circuit board assembly 102 forms a backplane or midplane assembly, and the second circuit board assembly 104 forms a daughter card assembly. The daughter card assembly may be referred to as a line card or a switch card. The electrical connectors 108, 112 may be referred to as header and receptacle connectors, respectively, in some embodiments.

The electrical connector 108, 112 are configured to mate with each other during a mating operation. As such, either of the electrical connectors 108, 112 may be referred to as a mating connector. In the illustrated embodiment, only a single electrical connector 108 is shown mounted to the circuit board 106 and only a single electrical connector 112 is shown mounted to the circuit board 110. In other embodiments, however, the first circuit board assembly 102 may include multiple electrical connectors 108, and the second circuit board assembly 104 may include multiple electrical connectors 112.

The interconnection system 100 may be used in various applications that utilize ground conductors for controlling impedance and reducing crosstalk between signal conductors. By way of example only, the interconnection system 100 may be used in telecom and computer applications, routers, servers, and supercomputers. One or more of the electrical connectors described herein may be similar to electrical connectors of the STRADA Whisper or Z-PACK TinMan product lines developed by TE Connectivity. The electrical connectors may be capable of transmitting data signals at high speeds, such as 5 gigabits per second (Gb/s), 10 Gb/s, 20 Gb/s, 30 Gb/s, or more. In more particular embodiments, the electrical connectors may be capable of transmitting data signals at 40 Gb/s, 50 Gb/s, or more.

The interconnection system, electrical connector, and mating connector may include high-density arrays of signal pathways or contacts. For example, the electrical connector may include a high-density array of signal contacts, and the mating connector may include a high-density array of signal contacts (referred to as signal terminals). The signal terminals of the mating connector may engage the signal contacts of the electrical connector to form a high-density array of signal pathways of the interconnection system. A high-density array of signal contacts may have, for example, at least 12 signal contacts per 100 $mm^2$ along a front side of the electrical connector. In more particular embodiments, the high-density array may have at least 20 signal contacts per 100 $mm^2$ along the front side of the electrical connector.

As shown in FIG. 1, the interconnection system 100 is oriented with respect to mutually perpendicular axes 191, 192, 193, including a mating axis 191, a first lateral axis 192, and a second lateral axis 193. It should be understood that the interconnection system 100 may have any orientation with respect to gravity. For example, the first lateral axis 192 may extend parallel to a gravitational force direction in some embodiments, or the mating axis 191 may extend parallel to the gravitational force direction in other embodiments.

The electrical connector 112 includes a connector body 114 having a front side 116 that is configured to engage the electrical connector 108 and a mounting side 118 that is configured to engage an electrical component, which is the circuit board 110 in FIG. 1. In other embodiments, however, the mounting side 118 may engage another electrical component, such as another electrical connector or a communication device that is capable of electrically coupling to the electrical connector 112.

The connector body 114 may be a single physical structure or a plurality of discrete structures that are assembled together to form a unitary structure. For example, in the illustrated embodiment, the connector body 114 includes a connector housing or shroud 120 and a plurality of connector sub-modules 122. The electrical connector 112 includes eight (8) connector sub-modules 122 in the illustrated embodiment, but may include fewer or more connector sub-modules in other embodiments. As shown, the connector sub-modules 122 are stacked side-by-side along the second lateral axis 193. The connector housing 120 is secured to the stacked connector sub-modules 122 to hold the connector sub-modules 122 as a group. In the illustrated embodiment, the connector housing 120 comprises a single continuous piece of dielectric material that is, for example, molded to include the features shown and described herein.

In the illustrated embodiment, the mounting side 118 faces along the first lateral axis 192, and the front side 116 faces along the mating axis 191. As such, the electrical connector 112 may be referred to as a right-angle connector. In other embodiments, the mounting side 118 and the front side 116 may face in opposite directions along the mating axis 191. In such embodiments, the electrical connector 112 may be referred to as a vertical connector. Collectively, the connector sub-modules 122 form the mounting side 118. In alternative embodiments, the electrical connector 112 does not include multiple connector sub-modules. Instead, the electrical connector 112 may include only a single module body that is coupled to the connector housing 120. Yet in other embodiments, the electrical connector 112 does not include the connector housing 120.

The electrical connector 108 includes a connector body or housing 124 having a front side 126 configured to engage the electrical connector 112 and a mounting side 128 configured to engage an electrical component, which is the circuit board 106 in FIG. 1. In other embodiments, however, the mounting side 128 may engage another electrical component, such as another electrical connector or a communication device that is capable of electrically coupling to the electrical connector 108. In the illustrated embodiment, the connector body 124 comprises a single continuous piece of dielectric material that is, for example, molded to include the features illustrated and described herein. In other embodiments, the connector body 124 may be similar to the connector body 114 and include multiple discrete structures that are coupled to one another.

Figure 2:
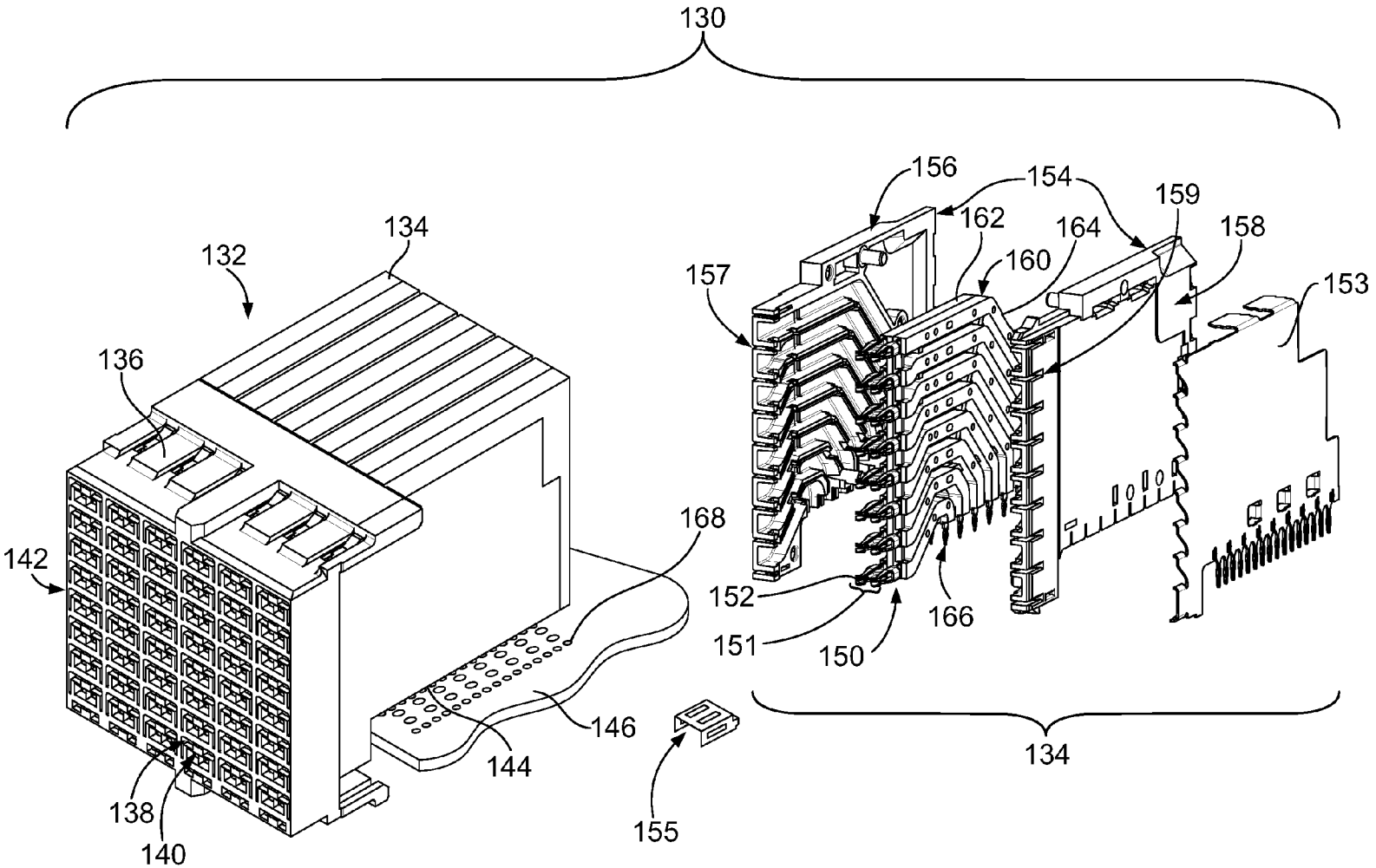
FIG. 2 is a partially exploded view of an electrical connector formed in accordance with an embodiment.

FIG. 2 is a partially exploded view of a circuit board assembly 130. The second circuit board assembly 104 (FIG. 1) may be similar to the circuit board assembly 130 and include the same or similar components. The circuit board assembly 130 includes an electrical connector 132 having a plurality of connector sub-modules 134, which may be similar or identical to the connector sub-modules 122 (FIG. 1). The connector sub-modules 134 are received within a connector housing 136. The connector housing 136 may be manufactured from a dielectric material, such as a plastic material. The connector housing 136 has a front side 142 and a plurality of cavity openings 138, 140 along the front side 142. The cavity openings 138, 140 may provide access to separate contact cavities (not shown) or a single contact cavity (not shown), such as the contact cavity 301 (shown in FIG. 6). The front side 142 defines a mating interface of the electrical connector 132 that engages another electrical connector, such as the electrical connector 108 (FIG. 1). Also shown, the electrical connector 132 includes a mounting side 144 that is mounted onto a circuit board 146.

FIG. 2 illustrates one of the connector sub-modules 134 in an exploded state. The connector sub-module 134 includes a plurality of signal conductors 150. Each signal conductor 150 extends between a mounting contact 166 and a signal contact 152, which is represented by two opposing contact beams. The signal contact 152 may be positioned adjacent to another single signal contact 152 that is also formed from two opposing contact beams. The two adjacent signal contacts 152 are hereinafter referred to as a signal pair 151.

Each connector sub-module 134 includes a column of signal pairs 151. The connector sub-module 134 also includes a connector shield 153 and a plurality of resonance-control shields 155. Optionally, the resonance-control shields 155 may mechanically and electrically couple to the connector shield 153. In FIG. 2, only one resonance-control shield 155 is shown, but it should be understood that the connector sub-module 134 includes a plurality of resonance-control shields 155. The connector shield 153 is positioned along a side of the connector sub-module 134. The resonance-control shields 155 are configured to form a column in which each resonance-control shield 155 at least partially surrounds a corresponding signal pair 151.

In some embodiments, the connector sub-module 134 includes a conductive holder 154. The conductive holder 154 may include a first holder member 156 and a second holder member 158 that are coupled together. The first and second holder members 156, 158 may be fabricated from a conductive material. For example, the first and second holder members 156, 158 may be metalized or be formed from a dielectric material having conductive fillers or particles. In such embodiments, the first and second holder members 156, 158 may provide electrical shielding for the electrical connector 132. When the first and second holder members 156, 158 are coupled together, the first and second holder members 156, 158 define at least a portion of a shielding structure.

The conductive holder 154 is configured to support a conductor assembly 160 that includes a pair of dielectric frames 162, 164. The dielectric frames 162, 164 are configured to surround the signal conductors 150. As shown, the signal contacts 152 and the mounting contacts 166 clear the dielectric frames 162, 164. The mounting contacts 166 are configured to mechanically engage and electrically couple to conductive vias 168 of the circuit board 146. Each of the signal contacts 152 is electrically coupled to a corresponding mounting contact 166 through the corresponding signal conductor 150.

As shown in FIG. 2, the first and second holder members 156, 158 include respective member slots 157, 159. When the first and second holder members 156, 158 are coupled to each other with the conductor assembly 160 therebetween, the member slots 157, 159 combine to form a plurality of holder slots (not shown). Each of the holder slots is configured to receive one of the resonance-control shields 155 such that the conductive holder 154 engages and electrically couples to the resonance-control shields 155. Optionally, the resonance-control shields 155 may engage the connector shield 153. The resonance-control shields 155 are positioned such that each of the resonance-control shields 155 at least partially surrounds a corresponding signal pair 151. In alternative embodiments, each of the resonance-control shields 155 may surround only a single signal contact.

The connector sub-modules 134 are coupled to the connector housing 136 such that the signal contacts 152 and the resonance-control shields 155 are aligned with the contact cavities (not shown) of the connector housing 136. The cavity openings 138, 140 provide access to corresponding contact cavities. The cavity opening 138 is sized and shaped to receive a ground shield (not shown), such as the ground shields 206 (shown in FIG. 3). The ground shields may engage the corresponding resonance-control shields 155 within the contact cavities. The cavity openings 140 are configured to receive corresponding signal terminals of a mating electrical connector (not shown) during a mating operation. Such signal terminals may be similar or identical to the signal terminals 204 (shown in FIG. 3). The signal terminals may engage the signal contacts 152 within the corresponding contact cavities.

Figure 3:
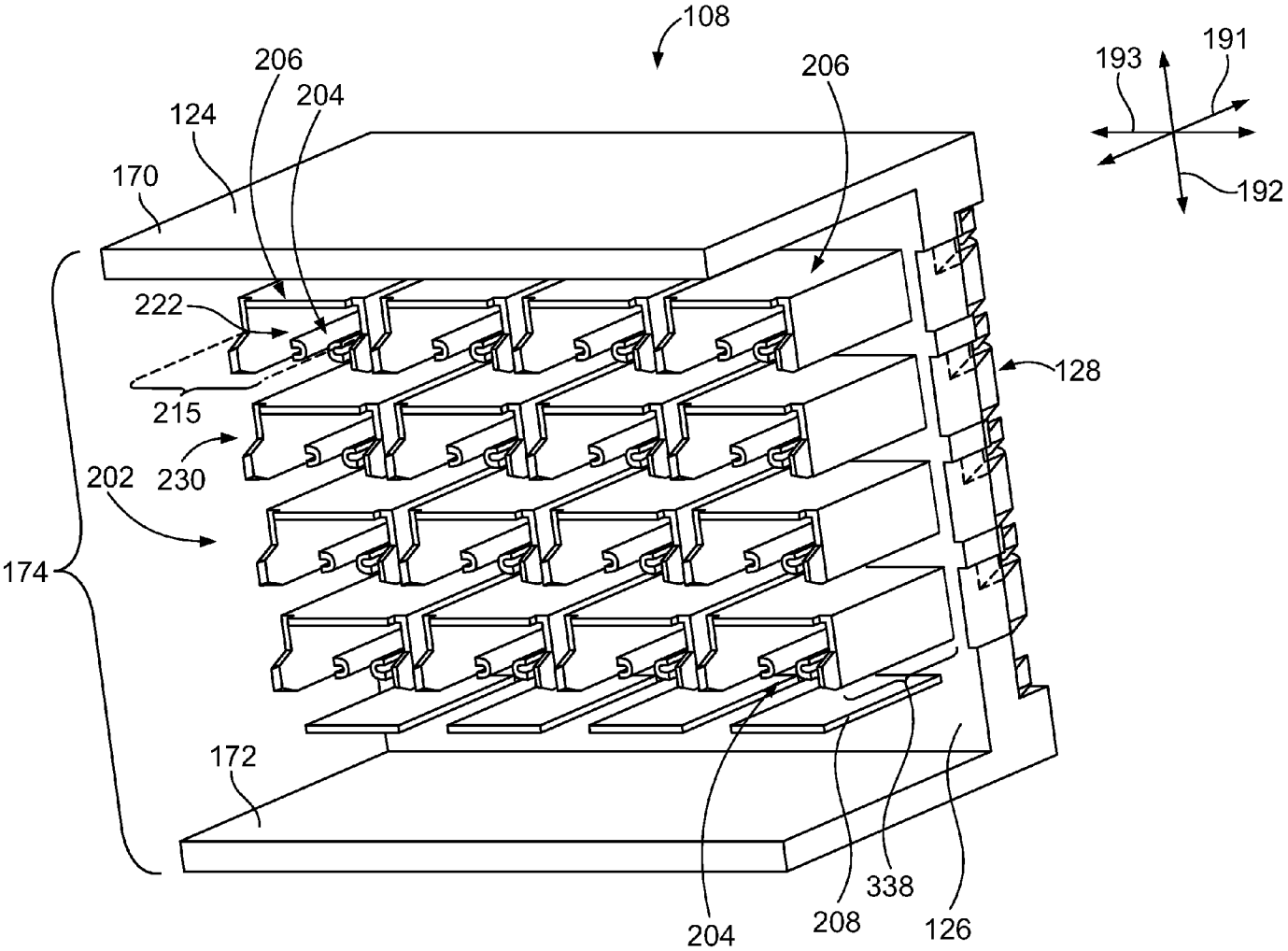
FIG. 3 is a front perspective view of the mating connector of FIG. 1.

FIG. 3 is an isolated perspective view of the electrical connector 108 in accordance with an embodiment. As shown, the connector body 124 includes a pair of body walls 170, 172 that extend away from the front side 126 along the mating axis 191. The body walls 170, 172 define a receiving space 174 therebetween that is sized and shaped to receive the connector housing 120 (FIG. 1) of the electrical connector 112 (FIG. 1). In the illustrated embodiment, the receiving space 174 is open-sided such that only the opposing body walls 170, 172 define the receiving space 174. In other embodiments, the connector body 124 may include one additional body wall (not shown) that extends between the body walls 170, 172 along the first lateral axis 192 or two additional body walls (not shown) that oppose each other and extend between the body walls 170, 172 along the first lateral axis 192. Accordingly, the receiving space 174 may be partially surrounded or entirely surrounded by the connector body 124.

The electrical connector 108 includes a conductor array 202 that is coupled to the connector body 124 and positioned within the receiving space 174. The conductor array 202 includes a plurality of signal terminals 204 and a plurality of ground shields 206, 208. The ground shields 206 are configured to engage corresponding resonance-control shields 250 (shown in FIG. 4) of the electrical connector 112 (FIG. 1). The signal terminals 204 and the ground shields 206, 208 are secured to the conductor body 124 in fixed positions. The signal terminals 204 and the ground shields 206, 208 extend through the connector body 124 between the front and mounting sides 126, 128. The signal terminals 204 and the ground shields 206, 208 may clear each of the front and mounting sides 126, 128 for engaging the electrical connector 112 (FIG. 1) and the circuit board 106 (FIG. 1), respectively, proximate to the front side 126 and the mounting side 128, respectively. As shown, the signal terminals 204 and the ground shields 206, 208 project from the front side 126 into an exterior of the connector body 124 within the receiving space 174.

The signal terminals 204 and the ground shields 206, 208 are configured to have a designated shape and are arranged in a predetermined pattern for engaging the electrical connector 112 (FIG. 1) and the circuit board 106 (FIG. 1). To this end, each of the signal terminals 204 and each of the ground shields 206, 208 includes a portion that engages the electrical connector 112 and a portion that engages the circuit board 106.

In the illustrated embodiment, the conductor array 202 is a two-dimensional array having multiple columns and rows that extend along the first and second lateral axes 192, 193, respectively. In other embodiments, the conductor array 202 may be a one-dimensional array that includes a single row or column of signal terminals 204 and ground shields 206. In particular embodiments, the conductor array 202 is a high-density array. For example, the conductor array 202 may include at least 12 signal terminals 204 per 100 $mm^2$ along the front side 126 of the electrical connector 108. In more particular embodiments, the conductor array 202 may include at least 20 signal terminals 204 per 100 $mm^2$ along the front side 126 of the electrical connector 108.

The signal terminals 204 and the ground shields 206 are arranged to form a plurality of terminal sub-assemblies 215. The conductor array 202 may include multiple rows 230 of the terminal sub-assemblies 215 in which each row 230 includes a plurality of the terminal sub-assemblies 215 arranged along the second lateral axis 193. In the illustrated embodiment, each of the terminal sub-assemblies 215 includes two signal terminals 204, which form a signal pair 222, and a corresponding ground shield 206 that is proximate to the signal pair 222. Each ground shield 206 may be shaped to surround the corresponding signal pair 222. For example, the ground shields 206 are C-shaped or U-shaped in the illustrated embodiment.

In other embodiments, however, one or more of the ground shields 206 may be L-shaped or rectangular-shaped such that the ground conductor forms a box that completely surrounds the signal pair 222. Alternatively, each ground shield 206 may be assembled from multiple discrete ground blades that are positioned to surround the corresponding signal pair 222. Although the terminal sub-assemblies 215 are shown and described as including a signal pair 222 and a corresponding ground shield 206, embodiments are not required to include signal pairs. For example, embodiments may include terminal sub-assemblies having only one signal terminal that is surrounded by one or more ground shields.

Each of the signal terminals 204 and the ground shields 206 project from the front side 126 in a forward direction along the mating axis 191 such that the signal terminals 204 and the ground shields 206 clear the dielectric material of the connector body 124 and are exposed for engaging corresponding contacts of the electrical connector 112 (FIG. 1). As shown, the ground shield 206 includes a stub portion 338. The stub portion 338 represents the portion of the ground shield 206 that is exposed to an exterior of the electrical connector 108.

Figure 4:
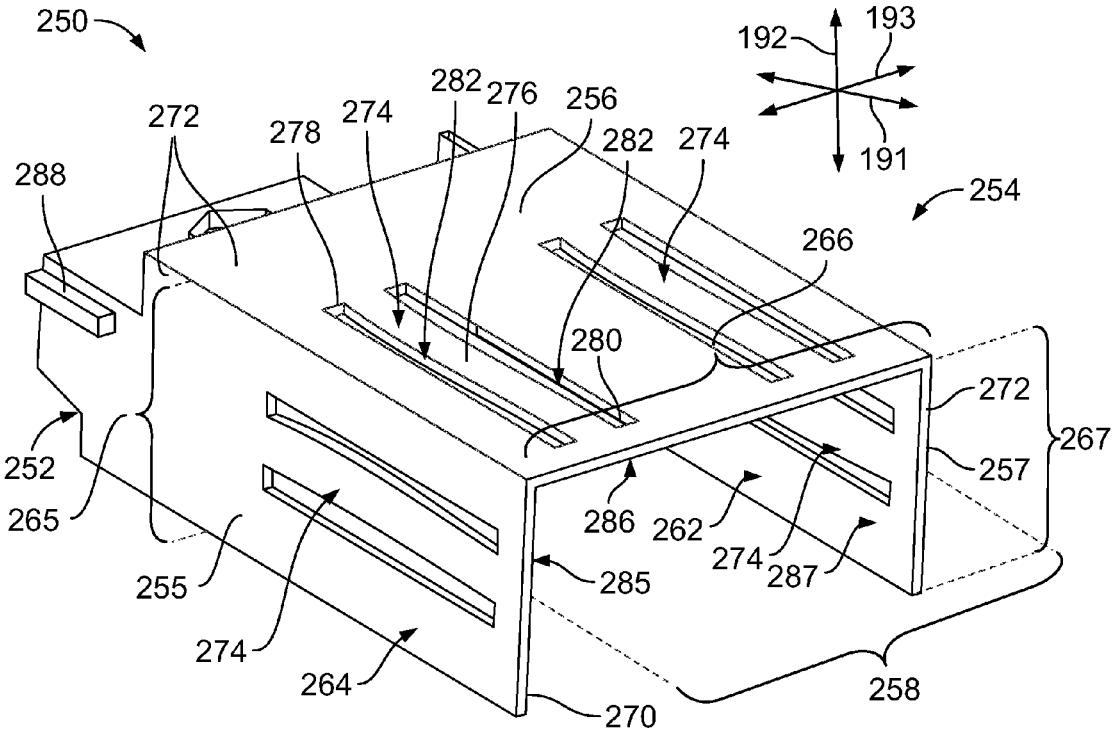
FIG. 4 is a perspective view of a resonance-control shield in accordance with an embodiment that may be used with the electrical connector of FIG. 1.

FIG. 4 is a perspective view of a resonance-control shield 250 in accordance with an embodiment that may be used with the receptacle connector of FIG. 1. For reference, the resonance-control shield 250 is oriented with respect to the axes 191-193. The resonance-control shield 250 is configured to directly interface with one of the ground shields 206 (FIG. 3) such that the resonance-control shield 250 and the corresponding ground shield 206 capacitively couple to each other. As described herein, the capacitive coupling may disrupt or impede the development of resonating conditions between the electrical connector 108 (FIG. 1) and the electrical connector 112 (FIG. 1).

The resonance-control shield 250 includes a shield base 252 and a damper body 254 that is coupled to the shield base 252. The damper body 254 is configured to directly interface with the stub portion 338 (FIG. 3) of the ground shield 206. The damper body 254 includes a plurality of damping walls 255, 256, 257 that define a receiving space or cavity 258. The damping wall 256 extends between and joins the damping walls 255, 257. The damping walls 255, 257 may oppose each other with the receiving space 258 therebetween.

In some embodiments, the resonance-control shield 250 may be stamped-and-formed from sheet metal, although it is contemplated that the resonance-control shield 250 may be made by other processes. For example, the resonance-control shield 250 may be 3D printed, molded with a dielectric material having conductive particles, or may be molded from dielectric material and then plated with metal. The damping walls 255-257 may be portions of one unitary structure. In other embodiments, the damping walls 255-257 may be discrete elements that are positioned relative to each other to form the designated shape of the resonance-control shield 250. As shown, the damping walls 255-257 are arranged such that the resonance-control shield 250 or, more specifically, the damper body 254 has a non-planar or three-dimensional (3D) structure that defines the receiving space 258. In the illustrated embodiment, the damper body 254 is U-shaped or C-shaped. In other embodiments, the resonance-control shield 250 may be L-shaped, V-shaped, I-shaped, or X-shaped. In other embodiments, the resonance-control shield 250 may be blade-shaped, such that the resonance-control shield 250 includes only one of the damping walls 255-257.

The damper body 254 includes an inner body surface 262 and an outer body surface 264. The inner body surface 262 may define the receiving space 258. The damper body 254 also has a leading edge 270. Each of the damping walls 255-257 includes a portion or segment of the leading edge 270. In an exemplary embodiment, the leading edge 270 represents the portion of the damper body 254 that is furthest from the shield base 252.

In some embodiments, each of the damping walls 255-257 includes a wall body 272 and one or more spring members 274. The spring member(s) 274 extend away from the respective wall body 272 and are configured to engage the ground shield 206 (FIG. 3) at one or more contact zones 360 (shown in FIG. 9). The contact zones 360 represent interfaces that direct current (DC) may propagate through. In the illustrated embodiment, the spring members 274 constitute resilient beams 276 that extend across and couple to opposite inner edges 278, 280 of the corresponding damping wall. The resilient beams 276 are defined between two slots 282. The spring members 274 (or resilient beams 276) are configured to engage the ground shield 206 and be deflected away from the receiving space 258. The resilient beams 276 may be shaped to extend into the receiving space 258. As shown, the damping wall 256 includes two spring members 274, and the damping walls 256, 257 each include one spring member 274. The spring members 274 may be positioned such that the contact zones 360 are located at designated positions along the ground shield 206.

The shield base 252 is configured to be secured to a conductive holder 326 (shown in FIG. 7), which may be similar to the conductive holder 154 (FIG. 2). To this end, the shield base 252 may be shaped to form an interference fit or frictional engagement with the conductive holder 326. For example, the shield base 252 may include coupling features 288 that engage features of the conductive holder 326. In the illustrated embodiment, the coupling features 288 are projections or tabs, but may take other shapes in other embodiments. The shield base 252 may be sized and shaped to be inserted into a holder slot (not shown) that is defined by the conductive holder 326.

The damping walls 255-257 have respective broad surfaces 285-287. The broad surfaces 285-287 are portions of the inner body surface 262. The damping walls 255-257 have wall widths 265, 266, 267, respectively. The wall widths 265, 267 are measured along the first lateral axis 192, and the wall width 266 is measured along the second lateral axis 193. In the illustrated embodiment, the wall widths 265, 267 have the same dimension, and the wall width 266 has a greater dimension than each of the wall widths 265, 267. However, in other embodiments, the wall widths 265-267 may have different relative dimensions than those shown in FIG. 4. In some embodiments, the damping walls 255, 257 may be referred to as side walls, and the damping wall 256 may be referred to as a broadside wall.

Figure 5:
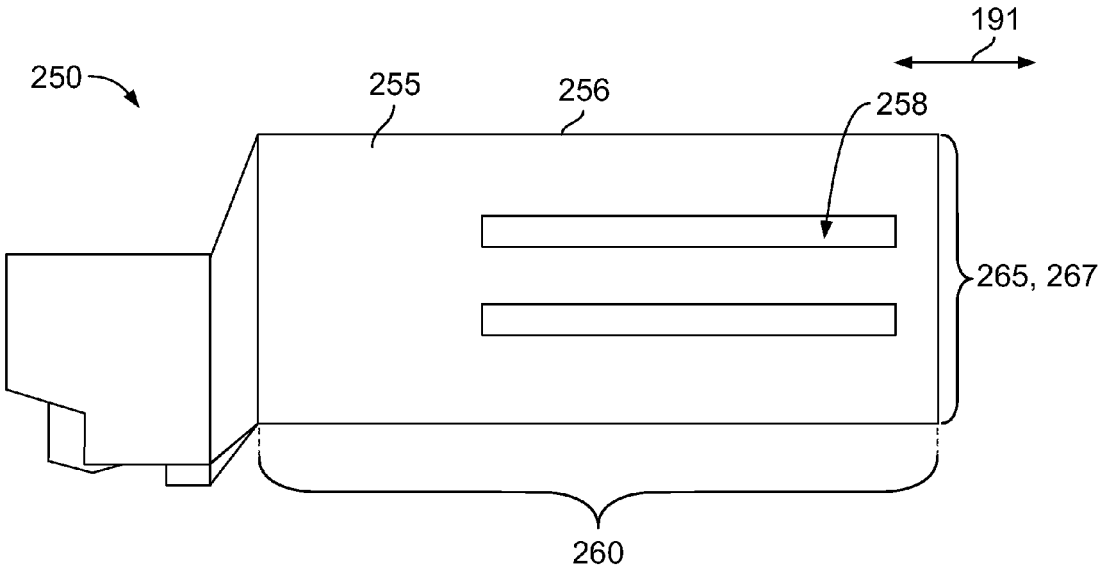
FIG. 5 is a side view of the resonance-control shield of FIG. 4.

FIG. 5 is a side view of the resonance-control shield 250. In the illustrated embodiment, each of the damping walls 255, 256, and the damping wall 257 (FIG. 4) has a common wall length 260 that is measured along the longitudinal axis 191. In other embodiments, however, the damping walls 255-257 may have different lengths. As described herein, the receiving space 258 is sized and shaped to receive the ground shield 206 (FIG. 3), and the damping walls 255-257 are sized and shaped to directly interface with and capacitively couple to the ground shield 206.

Accordingly, the length 260 of the damping walls 255-257, the wall widths 265, 267, and the wall width 266 (FIG. 4) may be configured to achieve a designated electrical performance for the interconnection system 100 (FIG. 1). For example, the broad surface 285 (FIG. 4) may have a surface area that is determined by the wall length 260 and the wall width 265, the broad surface 286 (FIG. 4) may have a surface area that is determined by the wall length 260 and the wall width 266, and the broad surface 287 (FIG. 4) may have a surface area that is determined by the wall length 260 and the wall width 267. The surfaces areas of the broad surfaces 285-287 may be selectively configured to increase or decrease an amount of capacitance between the ground shield 206 (FIG. 3) and the resonance-control shield 250 to control unwanted resonance within the interconnection system 100 (FIG. 1).

Figure 6:
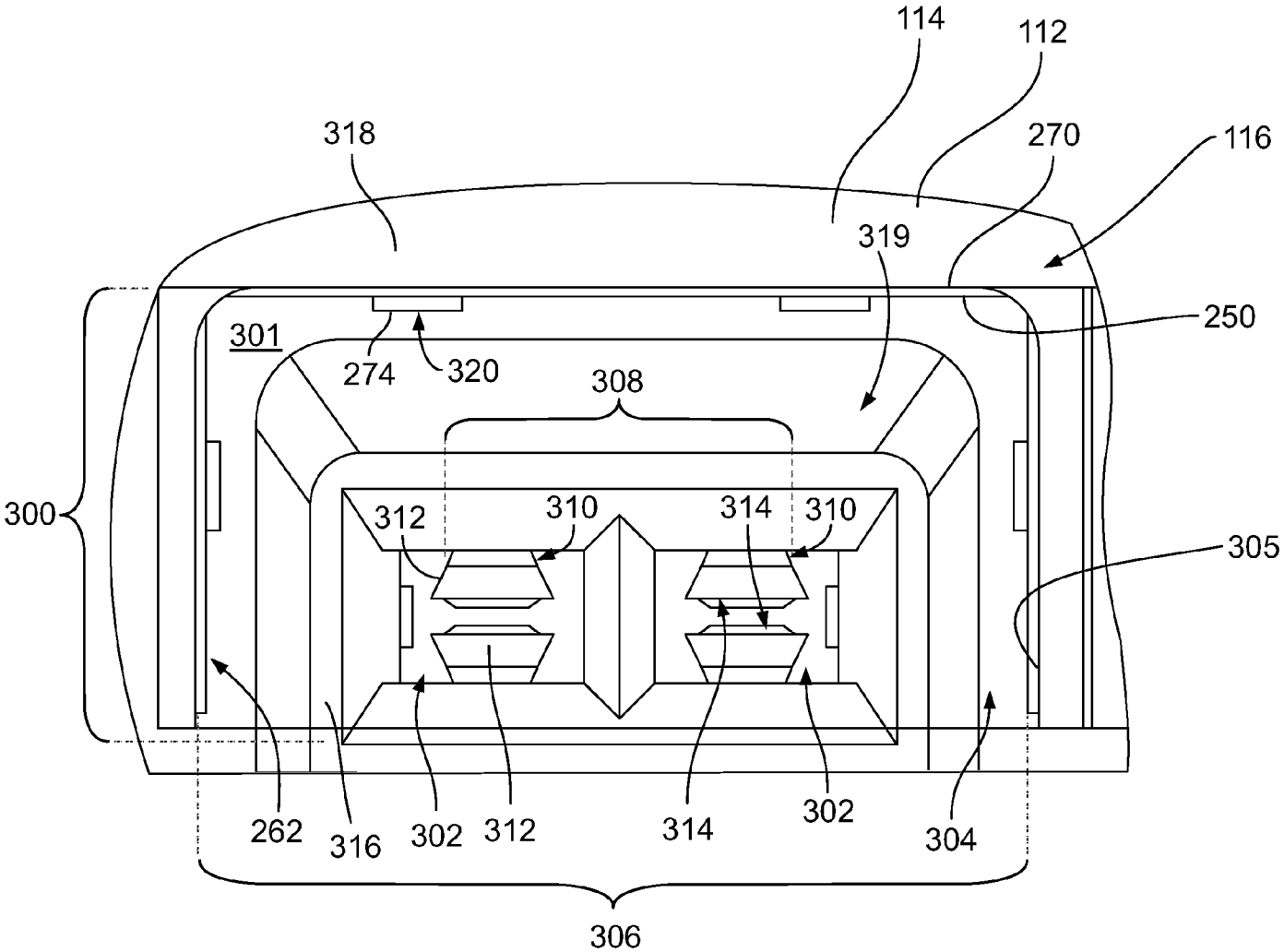
FIG. 6 is a plan view of a portion of a front side of the electrical connector of FIG. 1.

FIG. 6 is a plan view of a portion of the front side 116 of the electrical connector 112. In particular, FIG. 6 shows a single access sub-array 300 that includes two cavity openings 302 and a cavity opening 304. The cavity openings 302, 304 provide access to a common contact cavity 301 of the connector body 114. Each contact cavity 301 has a single contact sub-assembly 306 disposed therein, but it is understood that the electrical connector 112 may include an array of contact sub-assemblies 306. In the illustrated embodiment, each of the contact sub-assemblies 306 includes a signal pair 308 of signal contacts 310 and one of the resonance-control shields 250. In FIG. 6, a portion of the leading edge 270 of the resonance-control shield 250 is shown within the contact cavity 301. Also shown, the spring members 274 have coupling areas 320 that are positioned within the contact cavity 301. The coupling areas 320 represent the portions of the spring members 274 that engage the ground shield 206 (FIG. 3).

Each signal contact 310 includes a pair of contact beams 312 having respective mating areas 314 that face each other. The two mating areas 314 of a single signal contact 310 are configured to engage one of the signal terminals 204 (FIG. 3). In other embodiments, the contact sub-assembly 306 may include only one signal contact. Each of the cavity openings 302 is configured to receive a single signal terminal 204, and the cavity opening 304 is configured to receive a single ground shield 206 (FIG. 3). The cavity openings 302 are defined by a center housing portion 316 of the connector body 114. The cavity opening 304 is partially defined by the center housing portion 316 and partially defined by an outer housing portion 318 of the connector body 114. The center housing portion 316 separates the cavity openings 302 from the cavity opening 304. The center housing portion 316 has a beveled or chamfered surface 319 that facilitates directing the ground shield 206 into the cavity opening 304. The cavity opening 304 and the ground shield 206 may be similarly shaped such that the ground shield 206 may be inserted therein. In the illustrated embodiment, the cavity opening 304 is U-shaped or C-shaped. In other embodiments, the cavity opening 304 may be L-shaped, rectangular, or slot-shaped.

In some embodiments, the inner body surface 262 of the resonance-control shield 250 defines an inner profile of the resonance-control shield 250. The cavity opening 304 may be defined by an outer opening edge 305 of the connector body 114. As shown in FIG. 6, the outer opening edge 305 and the inner body surface 262 may be sized and shaped to permit the ground shield 206 (FIG. 3) to be inserted into the contact cavity 301 and engage the resonance-control shield 250 or, more specifically, the spring members 274.

Figure 7:
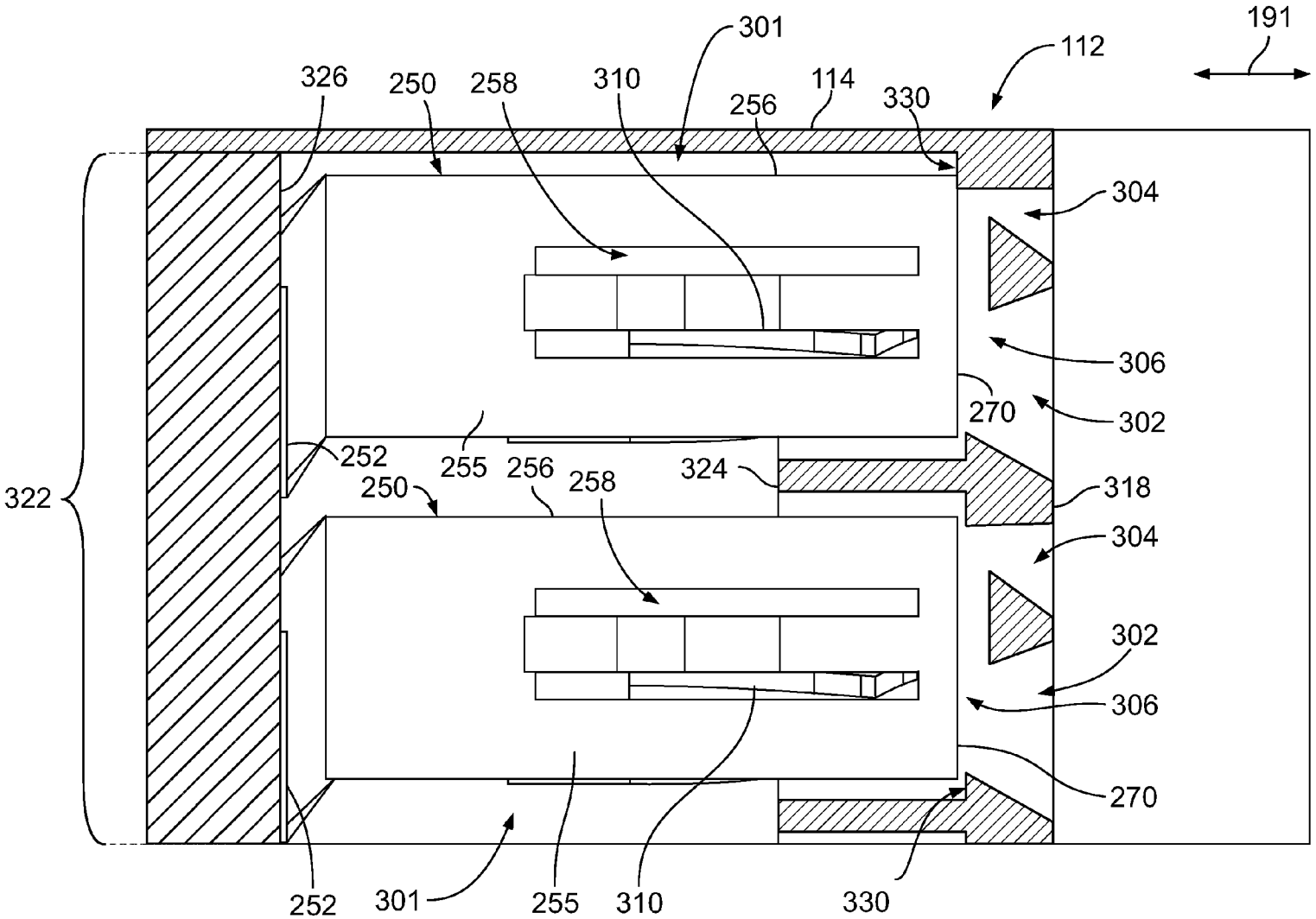
FIG. 7 is a cross-section of the electrical connector of FIG. 1 showing resonance-control shields disposed within respective contact cavities.

FIG. 7 is a cross-section of the electrical connector 112 prior to the electrical connector 112 engaging the electrical connector 108 (FIG. 1) during the mating operation. The connector body 114 defines a plurality of the contact cavities 301. As shown, each of the contact cavities 301 may form a portion of a larger housing cavity 322. More specifically, each contact cavity 301 may represent a localized region of the housing cavity 322 that has a contact sub-assembly 306 disposed therein. In FIG. 7, adjacent contact cavities 301 are at least partially separated by the outer housing portion 318 and an inner housing wall 324 of the connector body 114. Also shown in FIG. 7, the shield bases 252 are secured to the conductive holder 326. Although not shown, the shield bases 252 may be inserted into holder slots of the conductive holder 326 and engage the conductive holder 326.

As described herein, each contact sub-assembly 306 may include a resonance-control shield 250 and one or more signal contacts 310. The resonance-control shield 250 is positioned relative to the cavity opening 304 such that the ground shield 206 (FIG. 3) is received within the receiving space 258 of the resonance-control shield 250 when the ground shield 206 advances through the cavity opening 304 along the mating axis 191. The signal contacts 310 are each positioned relative to the corresponding cavity opening 302 such that the signal terminal 204 (FIG. 3) engages the corresponding signal contact 310 when the signal terminal 204 advances through the cavity opening 302 along the mating axis 191.

In some embodiments, the connector body 114 may be shaped to engage the resonance-control shields 250 and align the resonance-control shields 250 relative to the corresponding cavity opening 304. In some embodiments, the resonance-control element 250 may be sized and shaped such that the resonance-control element 250 is incapable of moving through the cavity opening 304. For example, the leading edge 270 may be shaped to have an outer profile that is larger than the cavity opening 304. In some embodiments, the leading edge 270 of the resonance-control element 250 may engage an interior surface 330 of the connector body 114. In the illustrated embodiment, the leading edge 270 along the damping wall 256 engages the interior surface 330 of the connector body 114. The damping wall 255 and/or the damping wall 257 (FIG. 4) may also engage the interior surface 330. As such, the interior surface 330 may effectively block the resonance-control element 250 from moving into the cavity opening 304.

Figure 8:
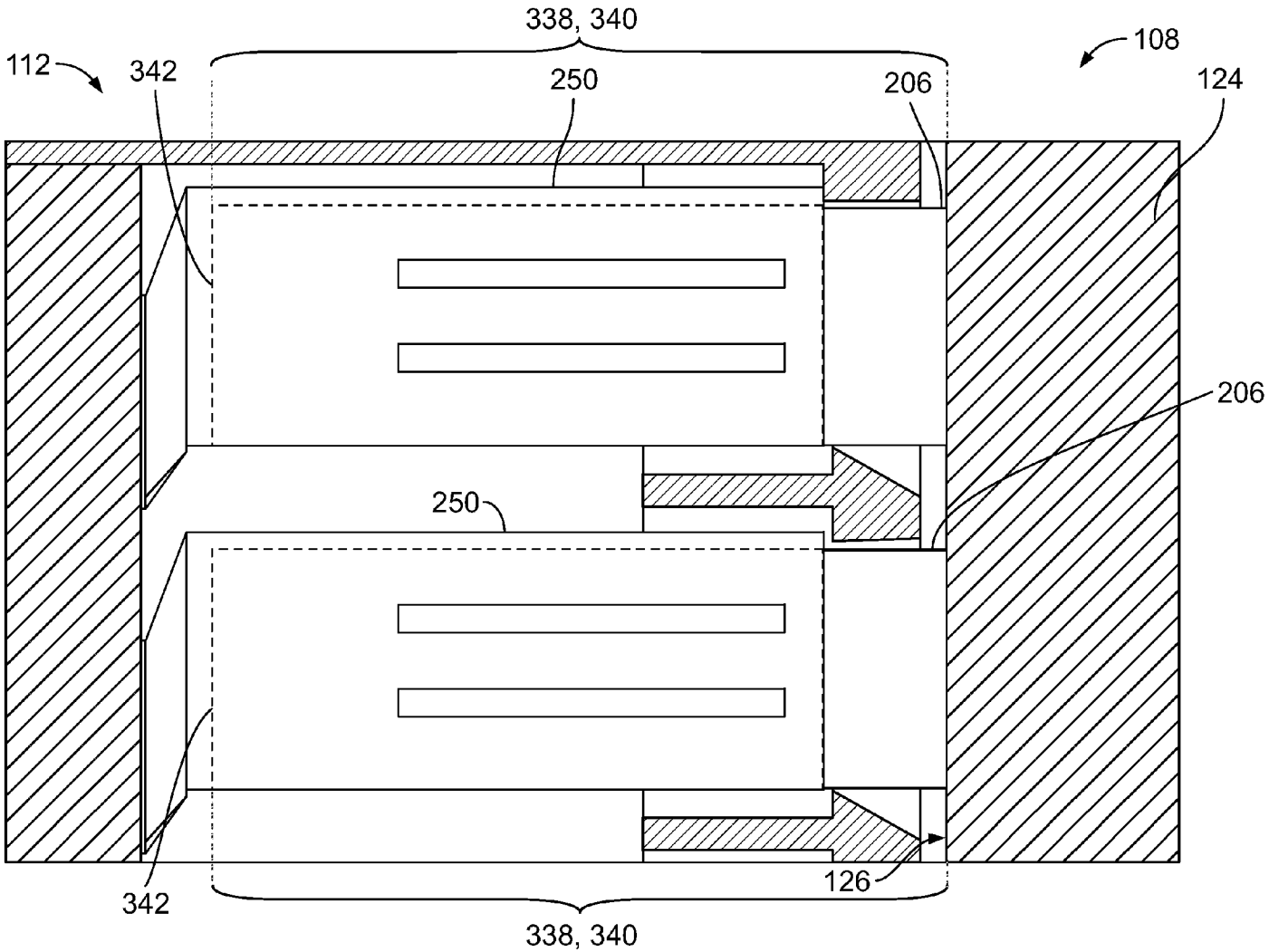
FIG. 8 is a cross-section of a portion of the interconnection system after the mating connector and the electrical connector have been mated.

FIG. 8 is a cross-section of the interconnection system 100 (FIG. 1) after the electrical connector 112 and the electrical connector 108 have been mated to each other. In FIG. 8, each of the resonance-control shields 250 has received a corresponding ground shield 206 within the receiving space 258 (FIG. 4). The ground shields 206 within the corresponding receiving spaces 258 are represented by dashed lines. The stub portions 338 of the ground shields 206 project from the front side 126 of the connector body 124 of the electrical connector 108. The stub portions 338 have respective stub lengths 340 that are measured between the front side 126 and a leading edge 342 of the ground shield 206. The leading edges 342 may directly interface with a portion of the resonance-control shield 250. For example, the leading edge 342 may engage the resonance-control shield 250, or a nominal gap may exist between the leading edge 342 and the resonance-control shield 250.

As shown, a majority of the stub portion 338 for each of the ground shields 206 is located within the receiving space 258 of the corresponding resonance-control shield 250. In some embodiments, at least 50% of the stub length 340 is positioned within the receiving space 258. In certain embodiments, at least 65% of the stub length 340 is positioned within the receiving space 258. In more particular embodiments, at least 75% of the stub length 340 is positioned within the receiving space 258.

Figure 9:
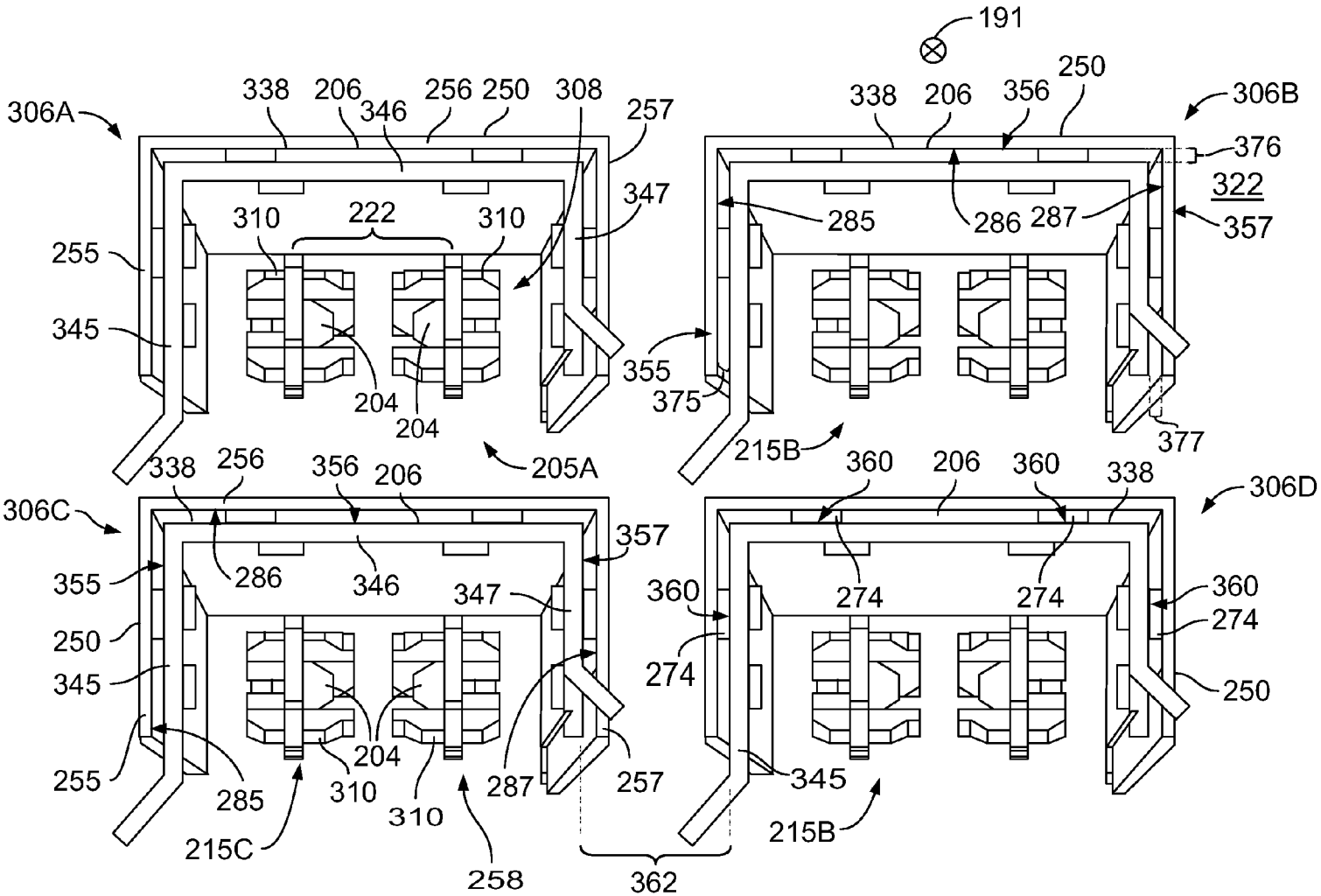
FIG. 9 is an end view of a plurality of ground shields of the mating connector mated with corresponding resonance-control shields of the electrical connector. For illustrative purposes, other components of the mating and electrical connectors have been removed.

FIG. 9 shows an end view of four contact sub-assemblies 306A, 306B, 306C, 306D in the housing cavity 322 when the contact sub-assemblies 306A-306D are engaged with terminal sub-assemblies 215A, 215B, 215C, 215D, respectively, after the mating operation. For illustrative purposes, the connector body 114 (FIG. 1) of the electrical connector 112 (FIG. 1) and the connector body 124 (FIG. 1) of the electrical connector 108 (FIG. 1) are not shown. It should be understood that each of the contact sub-assemblies 306A-306D and each of the terminal sub-assemblies 215A-215D include identical elements and features in the illustrated embodiment. For clarity, however, each of these elements or features may not be referenced in FIG. 9.

In the illustrated embodiment, the stub portion 338 of each of the ground shields 206 includes shield walls 345, 346, and 347. As shown with respect to the terminal sub-assembly 215C, the shield walls 345-347 have respective broad surfaces 355, 356, 357. The broad surfaces 285-287 of the resonance-control shield 250 face and capacitively couple to the broad surfaces 355-357, respectively, of the ground shield 206. As such, the ground shields 206 directly interface with the corresponding resonance-control shields 250. In an exemplary embodiment, as shown with respect to the terminal sub-assembly 215D and the contact sub-assembly 306D, the spring members 274 of the resonance-control shields 250 engage the ground shield 206 at the contact zones 360. Current may propagate through the contact zones 360 during operation of the interconnection system 100 (FIG. 1). In other embodiments, the resonance-control shield 250 may include more or fewer spring members 274. In alternative embodiments, the resonance-control shield 250 may not have the spring members 274.

In an exemplary embodiment, the ground shields 206 may be nested within corresponding resonance-control shields 250. More specifically, each of the resonance-control shields may include multiple damping walls that are coupled to each other and are substantially perpendicular to each other. These damping walls may be positioned adjacent to corresponding shield walls of the ground shield. For example, the damping walls 255, 256 are coupled to each other and are perpendicular to each other. The damping walls 256, 257 are coupled to each other and are perpendicular to each other. Accordingly, each of the contact cavities 301 (FIG. 7) is configured to permit (a) the shield wall 345 of the ground shield 206 to be positioned between one of the signal contacts 310 and the damping wall 255; (b) the shield wall 346 of the ground shield 206 to be positioned between one of the signal contacts 310 and the damping wall 256; and (c) the shield wall 347 of the ground shield 206 to be positioned between one of the signal contacts 310 and the damping wall 257.

In the illustrated embodiment, the interconnection system 100 (FIG. 1) is devoid of separate ground contacts within the receiving spaces 258 of the resonance-control shields 250. For example, the interconnection system 100 is devoid of a ground contact that is positioned between the ground shield 206 and the signal contacts 310. In other embodiments, however, the interconnection system 100 may include a ground contact positioned between the ground shield 206 and the signal contacts 310.

During operation of the interconnection system 100 (FIG. 1), electrical energy may exist between the shield walls 345-347 of the ground shields 206. As one example, a physical gap 362 exists between the shield wall 347 of the terminal sub-assembly 215C and the shield wall 345 of the terminal sub-assembly 215D. As electrical energy propagates through the signal terminals 204 and the signal contacts 310, the shield walls 345-347 of the ground shields 206 may support electrical energy that radiates from the signal terminals 204 and the signal contacts 310. The ground shields 206 may form one or more resonant cavities within the housing cavity 322. As electrical energy propagates within each resonant cavity along the mating axis 191, reflections between the circuit board 106 (FIG. 1) and the electrical connector 112 (FIG. 1) can occur and be supported by the shield walls 345-347.

Without the resonance-control shields 250, such reflections may form a standing wave (or resonating condition) at certain frequencies. The standing wave (or resonating condition) may cause electrical noise that, in turn, may increase return loss and/or crosstalk and reduce throughput of the interconnection system 100 (FIG. 1). The resonance-control shields 250 are configured to impede the development of these standing waves (or resonating conditions) at certain frequencies and, consequently, reduce the unwanted effects of the electrical noise. For example, in some embodiments, the resonance-control shields 250 may absorb some of the electrical energy that propagates through the corresponding ground cavity and drain the electrical energy. In some embodiments, the resonance-control shields 250 effectively change or dampen the reflections such that the standing wave (or the resonating condition) is not formed during operation of the interconnection system 100.

As shown with respect to the terminal sub-assembly 215B and the contact sub-assembly 306B, the resonance-control shield 250 and the ground shield 206 are separated from each other by capacitive gaps 375-377. The capacitive gap 375 exists between the broad surface 285 of the resonance-control shield 250 and the broad surface 355 of the ground shield 206. The capacitive gap 376 exists between the broad surface 286 of the resonance-control shield 250 and the broad surface 356 of the ground shield 206. The capacitive gap 377 exists between the broad surface 287 of the resonance-control shield 250 and the broad surface 357 of the ground shield 206.

Effectiveness of the resonance-control shields 250 may depend on the number and location of the contact zones 360 and an amount of capacitance generated by the broad surfaces 285-287 of the resonance-control shields 250 and the corresponding broad surfaces 355-357 of the ground shields 206. The capacitance may depend on the amount of surface area that the resonance-control shield 250 and the ground shield 206 overlap and the sizes of the capacitive gaps. For example, the capacitance may increase if the overlapping area is increased and/or the capacitive gap is decreased. The capacitance may decrease if the overlapping area is decreased and/or the capacitive gap is increased.

The capacitive gaps 375-377 may be common between each pair of opposing broad surfaces. For example, the capacitive gap 375 between the broad surface 285 and the broad surface 355 may be the same as the capacitive gap 376 between the broad surface 286 and the broad surface 356. In other embodiments, however, one or more of the capacitive gaps 375-377 may be different. By way of example, one or more of the capacitive gaps 375-377 may be at most 0.40 mm.

In some embodiments, one or more of the capacitive gaps 375-377 may be at most 0.30 mm. In particular embodiments, one or more of the capacitive gaps 375-377 may be at most 0.25 mm or, more particularly, at most 0.20 mm. In certain embodiments, one or more of the capacitive gaps 375-377 may be at most 0.15 mm.

By way of example, the overlapping area between broad surfaces that face each other may be at least 2.5 $mm^2$. In some embodiments, the overlapping area between broad surfaces that face each other may be at least 4.0 $mm^2$. In some embodiments, the overlapping area between broad surfaces that face each other may be at least 5.0 $mm^2$. The total overlapping area between the ground shield and the corresponding resonance-control shield may be at least 3.0 $mm^2$ or at least 5.0 $mm^2$. In some embodiments, the total overlapping area between the ground shield and the corresponding resonance-control shield may be at least 7.5 $mm^2$. In particular embodiments, the total overlapping area between the ground shield and the corresponding resonance-control shield may be at least 10.0 $mm^2$ or, more particularly, at least 12.0 $mm^2$. In more particular embodiments, the total overlapping area between the ground shield and the corresponding resonance-control shield may be at least 15.0 $mm^2$.

In some embodiments, a majority of one or more of the broad surfaces 355-357 of the ground shield 206 overlap with the respective broad surfaces 285-287 of the corresponding resonance-control shield 250. In some embodiments, a majority of one or more of the broad surfaces 285-287 of the resonance-control shield 250 overlap with the respective broad surfaces 355-357 of the corresponding ground shield 206.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The patentable scope should, therefore, be determined with reference to the appended claims, along with the full scope of equivalents to which such claims are entitled.

As used in the description, the phrase "in an exemplary embodiment" and the like means that the described embodiment is just one example. The phrase is not intended to limit the inventive subject matter to that embodiment. Other embodiments of the inventive subject matter may not include the recited feature or structure. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112(f), unless and until such claim limitations expressly use the phrase "means for" followed by a statement of function void of further structure.

What is claimed is:

1. An interconnection system comprising:

a mating connector including a plurality of terminal sub-assemblies, each of the terminal sub-assemblies including a signal terminal and a ground shield that is proximate to the signal terminal to shield the signal terminal from other terminal sub-assemblies; and an electrical connector comprising a plurality of contact sub-assemblies that each include a signal contact and a resonance-control shield that is proximate to the signal contact of the corresponding contact sub-assembly;

wherein the terminal sub-assemblies of the mating connector engage corresponding contact sub-assemblies of the electrical connector when the mating and electrical connectors are mated, the signal terminals of the terminal sub-assemblies engaging the signal contacts of the corresponding contact sub-assemblies, each of the ground shields of the terminal sub-assemblies being inserted between the resonance-control shield and the signal contact of the corresponding contact sub-assembly, the ground shield and the resonance-control shield having respective broad surfaces that face each other with a capacitive gap therebetween.

2. The interconnection system of claim 1, wherein each of the resonance-control shields includes a spring member that engages the corresponding ground shield at a contact zone such that current is permitted to flow through the contact zone.

3. The interconnection system of claim 1, wherein each of the ground shields includes a stub portion that is exposed to an exterior of the mating connector when the electrical connector and mating connector are unmated, the stub portion having the broad surface of the ground shield, wherein a majority of the broad surface of the ground shield overlaps with the broad surface of the corresponding resonance-control shield.

4. The interconnection system of claim 1, wherein each of the ground shields includes a stub portion that is exposed to an exterior of the mating connector when the electrical connector and mating connector are unmated, the stub portion having the broad surface of the ground shield, wherein a majority of the broad surface of the resonance-control shield overlaps with the broad surface of the ground shield.

5. The interconnection system of claim 1, wherein the broad surface of the ground shield and the broad surface of the resonance-control shield overlap each other by least 5 $mm^2$.

6. The interconnection system of claim 1, wherein the capacitive gap is at most 0.40 mm.

7. The interconnection system of claim 1, wherein the electrical connector includes a connector housing having a front side and a plurality of contact cavities having cavity openings along the front side, the contact sub-assemblies being positioned within corresponding contact cavities, the terminal sub-assemblies being inserted through corresponding cavity openings when the electrical connector and the mating connector are mated.

8. The interconnection system of claim 1, wherein the ground shields and the resonance-control shields have three-dimensional shapes, the ground shields being at least partially surrounded by the corresponding resonance-control shields.

9. The interconnection system of claim 1, wherein at least some of the resonance-control shields are C-shaped, U-shaped, L-shaped, V-shaped, I-shaped, X-shaped, or rectangular.

10. The interconnection system of claim 1, wherein the resonance-control shields and the ground shields have similar shapes such that the ground shields are nested within the corresponding resonance-control shields.

11. The interconnection system of claim 1, wherein the interconnection system is configured to transmit data signals at 20 gigabits/second or more and has a high-density array of signal pathways formed by the signal terminals and corresponding signal contacts.

12. An electrical connector comprising:

a connector housing having a front side configured to engage a mating connector, the connector housing including a plurality of contact cavities having cavity openings along the front side; and a plurality of contact sub-assemblies positioned within corresponding contact cavities, each of the contact sub-assemblies including a signal contact and a resonance-control shield that is proximate to the signal contact of the corresponding contact sub-assembly, the signal contacts being configured to engage respective signal terminals of a mating connector during a mating operation between the electrical connector and the mating connector, wherein each of the contact cavities and the contact sub-assembly within the corresponding contact cavity are configured to permit an associated ground shield of the mating connector to be inserted between the signal contact and the resonance-control shield of the contact sub-assembly during the mating operation.

13. The electrical connector of claim 12, wherein each of the resonance-control shields includes a wall body and a spring member that extends away from the wall body to engage the associated ground shield.

14. The electrical connector of claim 12, wherein the resonance-control shields form receiving spaces that are sized and shaped to receive the associated ground shields, the resonance-control shields including one or more spring members that are shaped to extend into the receiving space.

15. The electrical connector of claim 12, wherein each of the resonance-control shields includes first and second damping walls that are coupled to each other and are substantially perpendicular to each other.

16. The electrical connector of claim 12, wherein each of the resonance-control shields includes first and second damping walls that are coupled to each other and are substantially perpendicular to each other, wherein each of the contact cavities is configured to permit (a) a first shield wall of the associated ground shield to be positioned between the signal contact and the first damping wall and (b) a second shield wall of the associated ground shield to be positioned between the signal contact and the second damping wall.

17. The electrical connector of claim 12, wherein each of the resonance-control shields is one of C-shape, U-shaped, L-shaped, V-shaped, I-shaped, X-shaped, or rectangular.

18. The electrical connector of claim 12, wherein each of the resonance-control shields at least partially surrounds the signal contact of the corresponding contact sub-assembly, the electrical connector being devoid of ground contacts that are positioned between the signal contacts and the corresponding ground shields.

19. The electrical connector of claim 12, wherein each of the resonance-control shields includes a damper body having an inner body surface that is configured to surround and overlap with the ground shield.

20. The electrical connector of claim 12, wherein the signal contacts of the plurality of contact sub-assemblies form a high-density array of signal contacts and wherein the electrical connector is configured to transmit data signals at 20 gigabits/second or more.

* * * * *